US011519635B2

(12) United States Patent
Kozlov et al.

(10) Patent No.: US 11,519,635 B2
(45) Date of Patent: Dec. 6, 2022

(54) GAS FIRED PROCESS HEATER WITH ULTRA-LOW POLLUTANT EMISSIONS

(71) Applicant: GAS TECHNOLOGY INSTITUTE, Des Plaines, IL (US)

(72) Inventors: Aleksandr Kozlov, Buffalo Grove, IL (US); David Kalensky, Chicago, IL (US); Mark Khinkis, Morton Grove, IL (US); Vladimir Shmelev, Moscow (RU); Vladimir Nikolaev, Moscow (RU)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 533 days.

(21) Appl. No.: 16/547,873

(22) Filed: Aug. 22, 2019

(65) Prior Publication Data

US 2020/0064021 A1 Feb. 27, 2020

Related U.S. Application Data

(60) Provisional application No. 62/722,602, filed on Aug. 24, 2018.

(51) Int. Cl.

| | |
|---|---|
| ***F24H 1/20*** | (2022.01) |
| ***F23C 6/04*** | (2006.01) |
| ***F23D 14/02*** | (2006.01) |

(52) U.S. Cl.

CPC ..... *F24H 1/206* (2013.01); *F23C 6/045* (2013.01); *F23D 14/02* (2013.01); *F23D 2203/005* (2013.01); *F23D 2212/20* (2013.01)

(58) Field of Classification Search

CPC ..... F24H 1/206

See application file for complete search history.

(56) References Cited

U.S. PATENT DOCUMENTS

| | | | | |
|---|---|---|---|---|
| 1,706,416 A * | 3/1929 | Schwartz | F22B 13/005 | 122/156 |
| 1,816,419 A * | 7/1931 | Carson | F24H 1/205 | 122/156 |
| 1,884,746 A * | 10/1932 | Kline | F24C 3/042 | 126/92 AC |
| 3,324,924 A | 6/1967 | Hailstone | | |

(Continued)

FOREIGN PATENT DOCUMENTS

EP 0 239 189 A1 9/1987

OTHER PUBLICATIONS

U.S. Patent Office, English language version of the International Search Report, Form PCT/ISA/210 for International Application PCT/US2019/47875, dated Nov. 15, 2019 (1 page).

(Continued)

*Primary Examiner* — Nathaniel Herzfeld

(74) *Attorney, Agent, or Firm* — Pauley Erickson & Swanson

(57) ABSTRACT

Process heaters and associated methods of processing with ultra-low pollutant emissions are provided. The process heaters and methods utilize a heat exchange tube having disposed therein a radiant permeable matrix burner at a first end of the tube. The tube further includes a thermally insulated insert disposed adjacent the radiant burner opposite an oxidant-fuel mixer that feeds the burner. The process heaters and methods act to reduce emissions of CO and NOx.

20 Claims, 6 Drawing Sheets

(56) References Cited

U.S. PATENT DOCUMENTS

| | | | | |
|---|---|---|---|---|
| 3,701,340 | A | 10/1972 | Miller | |
| 4,329,943 | A * | 5/1982 | Schworer | F24H 9/1836 122/13.01 |
| 4,541,410 | A | 9/1985 | Jatana | |
| 4,899,696 | A * | 2/1990 | Kennedy | F24H 1/206 122/135.1 |
| 5,304,059 | A * | 4/1994 | Tanaka | F23C 3/002 431/170 |
| 5,355,841 | A | 10/1994 | Moore, Jr. et al. | |
| 5,511,516 | A | 4/1996 | Moore, Jr. et al. | |
| 5,924,390 | A | 7/1999 | Bock | |
| 6,036,480 | A | 3/2000 | Hughes et al. | |
| 6,391,469 | B1 * | 5/2002 | Ragland | B32B 3/28 428/593 |
| 6,698,386 | B1 | 3/2004 | Hoffman | |
| 6,997,701 | B2 | 2/2006 | Volkert et al. | |
| 7,360,506 | B2 | 4/2008 | Shellenberger et al. | |
| 8,167,610 | B2 | 5/2012 | Raleigh et al. | |
| 8,402,927 | B2 | 3/2013 | Home | |
| 9,568,213 | B2 | 2/2017 | Qiu et al. | |
| 9,709,265 | B2 * | 7/2017 | Sutherland | F23C 99/006 |
| 2017/0010019 | A1 * | 1/2017 | Karkow | F24H 1/285 |

OTHER PUBLICATIONS

U.S. Patent Office, English language version of the Written Opinion of the International Searching Authority, Form PCT/ISA/237 for International Application PCT/US2019/47875, dated Nov. 15, 2019 (7 pages).

"Metal Fibre Premix", Polidoro For Excellence In Combustion, Feb. 20, 2014, (4 pages).

* cited by examiner

GAS FIRED PROCESS HEATER WITH ULTRA-LOW POLLUTANT EMISSIONS

CROSS REFERENCE TO RELATED APPLICATION

This application claims the benefit of U.S. Provisional Patent Application, Ser. No. 62/722,602, filed on 24 Aug. 2018. The Provisional Application is hereby incorporated by reference herein in its entirety and is made a part hereof, including but not limited to those portions which specifically appear hereinafter.

BACKGROUND OF THE INVENTION

Field of the Invention

This invention relates generally to process heaters such as water heaters and boilers, and, more particularly, to improved performance and construction for gas fired process heaters. Particular areas of focus include burner, heat exchange, and heat exchange tube constructions and performance with particular emphasis on reducing or minimizing pollutant emissions.

Description of Related Art

Conventional gas fired process heaters commonly include a tank adapted to contain a body of liquid, e.g., water, a heat exchange tube in the liquid/water, and a burner producing hot combustion products directed into the heat exchange tube. The combustion products are typically vented or exhausted, e.g., vented or exhausted outside the room/building containing the process heater.

Various types of burners have been used for gaseous fuel combustion in process heaters. The attractiveness to manufactures and customers of particular or specific burners for use in or with process heaters typically involves three sometimes conflicting or contradicting factors or conditions, namely, cost, efficiency, and pollutant emissions (carbon monoxide CO and nitrogen oxides NOx). High efficiency burners are typically higher in cost and usually suffer from high emissions of either CO, NOx or both. Low NOx burners are usually high in CO emission and/or are not efficient as desired since high excess air is used for combustion to reduce NOx. High efficiency radiant burners can provide low NOx but suffer from high CO emissions.

SUMMARY OF THE INVENTION

The present invention contemplates a new and improved process heater construction which overcomes some or all of the above-identified problems as well as others. In accordance with a preferred embodiment there is provided a process heater of simpler construction which is economical to manufacture, economical to operate, burns fuel cleanly and answers governmental regulations.

Briefly stated, in accordance with one aspect of the invention, a process heater is provided having a tank adapted to contain a body of liquid, a heat exchange tube at least in part disposed in the liquid, a oxidant-fuel mixer, a radiant permeable matrix burner at the bottom and inside the heat exchange tube producing hot combustion products directed into the heat exchange tube, and a thermally insulated insert in the heat exchange tube above the burner. The combustion products can desirably be subsequently appropriately vented or exhausted.

A process heater in accordance with one preferred embodiment of the invention operates as follows: A body of liquid in the process heater tank is heated through a heat exchange tube in the tank and by thermal contact with the hot products of combustion resulting from the gaseous fuel flowing inside the heat exchange tube. To combust the gaseous fuel (e.g., natural gas), the fuel is mixed with combustion oxidant, e.g., air, by using a fuel injector or other mixing device. In a preferred embodiment, the air-fuel ratio is near or slightly above stoichiometric levels (e.g., 0-30% excess air). The air-fuel mixture enters a radiant burner and is combusted in a thin layer within a permeable matrix of the radiant burner and/or on the surface of the matrix. A large portion of heat from the combustion (~30%) is transferred through infrared radiation from the matrix to the heat exchange tube and to the liquid. The high radiation intensity essentially increases heat transfer from the combustion products to liquid through the heat exchange tube, reduces combustion temperature and results in lower nitrogen oxides (NOx) and carbon monoxide (CO) emissions (e.g., ~10 ppm or less at 3% oxygen (dry basis)) as compared to conventional non-radiant burners. A thermally insulated insert placed or disposed in the heat exchange tube above the burner prevents or reduces heat transfer from combustion products to the heat exchange tube, keeps the combustion products hot, thus essentially reducing carbon monoxide emissions to below 1-10 ppm as compared to combustion without such a thermally insulated insert. In addition, the radiant burner provides better utilization of heat from combustion compared to other existing process heater burners.

A general objective of the invention is to minimize or, preferably overcome, one or more of the problems or shortcoming of the prior art.

More particular or specific objectives of the invention include:

providing a process heater of improved operating characteristics which is inexpensive to manufacture on a production basis;

simplifying process heater design; and/or improving the efficiency of utilization of allocated heat from a process heater burner.

It is yet another object of the present invention to provide conditions for essential reduction of carbon monoxide in the flue gas; and to provide a process heater which has essentially reduced emissions of carbon monoxides at ultra-low (~8 ppm or less at 3% oxygen (dry basis)) NOx emissions.

As used herein, references to "high temperature" such as when referring to materials for use in construction of radiant permeable matrix burners are to be understood to generally refer to materials useful and functional at temperatures of 900° C. or greater. In view of higher material costs normally associated with higher temperature compatibility, temperatures of about 1400° C. form a general upper limit on such "high temperature" compatibility.

Further objects and advantages to the invention will be apparent from the following detailed description of preferred embodiments and from the accompanying drawings.

BRIEF DESCRIPTION OF THE DRAWINGS

Objects and features of this invention will be better understood from the following description taken in conjunction with the drawings, wherein.

As will be appreciated, certain standard elements not necessary for an understanding of the invention may have been omitted or removed from the drawings for purposes of facilitating illustration and comprehension. For example, although not specifically shown, it will be understood and appreciated that process heaters and, in particular, the radiant burners herein disclosed include or contain an appropriate or suitable ignition device such as known in the art.

DETAILED DESCRIPTION

Figure 1:
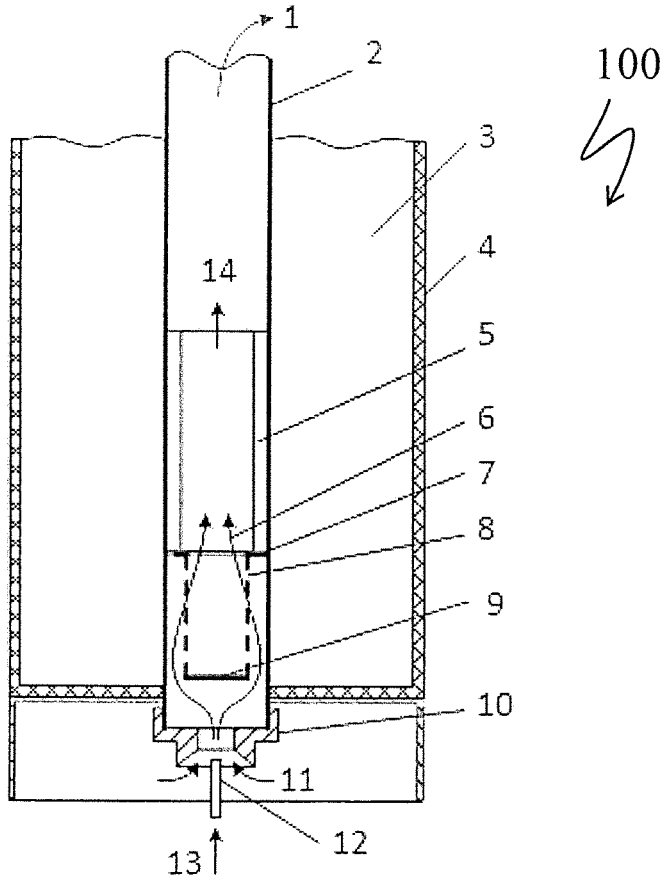
FIG. 1 is a simplified schematic of a gas fired process heater in accordance with one embodiment of the invention.

FIG. 1 illustrates a gas fired process heater 100 in accordance with one embodiment of the invention.

The gas fired process heater 100 includes a liquid tank 4 adapted to contain a body of a medium to be processed (e.g., heated) such as in the form of a liquid (e.g., water) 3, a heat exchange tube 2 partially submerged in the liquid 3, a permeable metal wire mesh matrix 8 such as in the form of a cylindrical shaped metal wire mesh of high temperature material that produces hot combustion products 6 directed into the heat exchange tube 2 with thermal insulating insert S in the heat exchange tube 2. After heat exchange with the heat exchange tube 2, the resulting cooled combustion products or flue gases are appropriately vented or exhausted, e.g., vented or exhausted outside the room/building containing the process heater. The permeable matrix burner includes a permeable metal wire mesh matrix 8, a burner top O-ring 7, a bottom end wall 9, and an oxidant-fuel mixer 10 with a fuel nozzle 12. Combustion oxidant (e.g., air) 11 and gaseous fuel (e.g., natural gas) 13 are mixed in the oxidant-fuel mixer 10.

The permeable metal wire mesh matrix 8 includes at least one layer of wire mesh made of high temperature (e.g., 900° C. or greater and typically up to 1400° C.) material such as made of FeCrAl alloy, for example, and such as with a wire diameter 0.1-1 mm. The wire mesh has a generally cylindrical shape with outside diameter d less than inside diameter of the heat exchange tube 2. The length l of the wire mesh cylinder can be estimated using the following formula:

$$l=P/PD/(\pi d)$$

where,

P is liquid heater power capacity, W;

PD is burner power density, W/cm$^2$;

$\pi$=3.14; and d is outside diameter of the wire mesh cylinder.

Power density is typically in a range of about 10-40 W/cm$^2$.

The oxidant-fuel mixture is combusted near and on the inside surface of the permeable metal wire mesh matrix. The metal wire mesh is heated by the combustion products and radiates inside and outside the permeable metal wire mesh matrix cylinder. Large amounts of heat are removed from the combustion zone by the radiation, thus reducing the flame temperature, as a result NOx emissions are reduced as compared to combustion with a non-radiant burner.

The inclusion or presence of the thermal insulating insert above the wire mesh limits the heat transfer from combustion products to the heat exchange tube thus keeping the temperature of the combustion products high, promoting CO oxidation to CO2 formation, and reducing harmful CO emissions. In accordance with one embodiment, the insert can be made of high temperature metal corrugated foil. In accordance with one embodiment, the insert desirably has the shape or form of an annular cylinder. The insert can be installed next to the heat exchange tube wall with or without insulation. The insert desirably serves or acts to prevent contact of combustion products with a cold heat exchange tube. A "thermally insulated insert" as used herein generally refers to an insert that is not in direct contact with the heat exchange tube in the assembly. While in practice the insert may be hot or heated to an elevated temperature, an air gap between the insert and the heat exchange tube acts or serves as an imperfect thermal insulator as there normally will be some heat losses due to radiation from the insert to the heat exchange tube. To minimize or prevent radiation heat losses from the insert, an insulation (such as ceramic, fiberglass, silica, mineral wool, etc. or the like) can be added to the insert. In accordance with one embodiment, the length of the insulating insert is in the range between (1-20) times d. The longer the insert, the lower the CO emissions can be received.

It is well known that increasing the temperature of combustion products leads to reduced CO emissions, while increasing the temperature leads to increased NOx emissions, and vice versa. In one embodiment of the present invention, the combustion products temperature is reduced in the flame first by radiation which leads to reduced NOx formation and high CO formation, then heat transfer from combustion products is suppressed to keep the temperature from further reduction thus allowing CO oxidation to form CO2. Suppressing heat transfer for CO reduction is not obvious for this case since (1) it has been done outside combustion zone and after the temperature of combustion products was already reduced by radiation, and further (2) suppressing heat transfer in gas fired devices like a process heater is counterintuitive.

Figure 2:
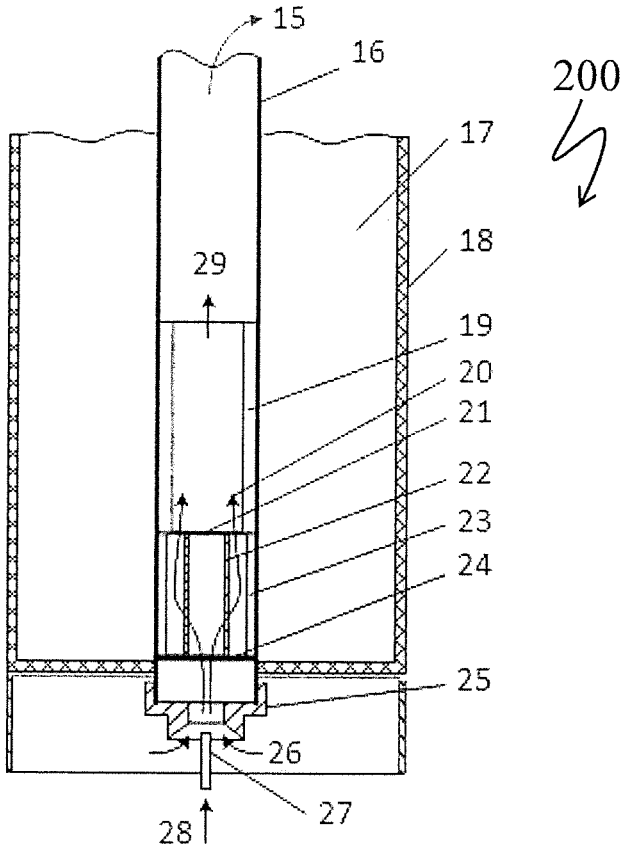
FIG. 2 is a simplified schematic of a gas fired process heater in accordance with another embodiment of the invention.

Turning to FIG. 2, there is shown a gas fired process heater 200 in accordance with another embodiment of the invention.

The gas fired process heater 200 includes a liquid tank 18 adapted to contain a body of medium to be processed (e.g., heated) such as in the form a liquid (e.g., water) 17, a heat exchange tube 16 partially submerged in the liquid, a permeable metal foam matrix 22 of high temperature material that produces hot combustion products 20 directed into the heat exchange tube 16 with a thermal insulating insert 19 disposed within the heat exchange tube 16. The burner exhaust gas 29 after heat exchange with the heat exchange tube 16 to form cooled combustion products or flue gases 15 are appropriately vented or exhausted, such as described above.

The permeable matrix burner includes a metal mat (e.g., foam or wire mesh) 22, a top end wall 21, a bottom O-ring 24, and an oxidant-fuel mixer 25 with a fuel nozzle 27. Combustion oxidant (e.g., air) 26 and gaseous fuel (e.g., natural gas) 28 are mixed in the oxidant-fuel mixer 25. Another thermal insulating insert 23 around the permeable matrix 22 is installed within the heat exchange tube 16. The thermal insert 23 can desirably serve to limit heat transfer from the combustion and combustion products to the heat exchange tube and keep combustion product temperatures high enough to promote CO oxidation to CO2 formation.

In accordance with one preferred embodiment, the metal foam matrix 22 is made of high temperature material (e.g., FeCrAl alloy). The matrix has cylindrical shape with an outside diameter d less than inside diameter of the heat exchange tube 16. The matrix wall thickness is desirably in the range between 3 and 20 mm. The length l of the metal foam cylinder can be estimated using the following formula:

$$l=P/PD(\pi d)$$

where,

P is process heater power capacity, W;

PD is burner power density, $W/cm^2$;

$\pi$=3.14; and d is outside diameter of the metal foam cylinder.

Power density is in the range 10-40 $W/cm^2$.

The oxidant-fuel mixture is combusted near and on the outside surface of the permeable metal matrix. The metal matrix is heated by the combustion products and radiates outside. A large amount of heat is removed from the combustion zone by the radiation, thus reducing the flame temperature, as a result NOx emissions are reduced as compared to combustion with a typical non-radiant burner.

The thermal insulating insert 23 can be installed around the permeable metal matrix in order to prevent overcooling the combustion products and provide conditions for further CO oxidation. The thermal insulating insert 19 above the metal foam matrix may have the shape of an annular cylinder and can desirably serve to limit the heat transfer from combustion products to the heat exchange tube thus keeping high temperature of the combustion products, promoting CO oxidation to CO2 formation, and reducing CO emissions. Both inserts can be made of high temperature metal corrugated foil. Either or both of the inserts can be used with or without added insulation. The inserts desirably prevent contact of combustion products with a cold heat exchange tube. In one preferred embodiment, the length of the first thermal insulating insert 23 is equal or less than the metal foam length. In one preferred embodiment, the length of the second insulating insert 19 is in the range between (1-20) times d. In general, the longer the insert 19, the lower the CO emissions can be received.

It is well known that the higher the temperature of combustion products the lower the CO emissions and increasing or higher temperature combustion products lead to increased NOx emissions, and vice versa. In the present invention, the combustion products temperature is reduced in the flame first by radiation which leads to reduced NOx and high CO production, then the heat transfer from combustion products is suppressed to keep the temperature from further reduction thus allowing oxidation of harmful CO to form CO2. It will be appreciated that suppressing heat transfer for CO reduction is not obvious for this case since (1) such suppression is being done outside combustion zone and after the temperature of combustion products was already reduced by radiation, and further (2) suppressing heat transfer in gas fired devices like a process heater is counterintuitive.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

Experimental Support

The following experimental study was conducted to support the present invention claims, the results are described below.

Figure 3A:
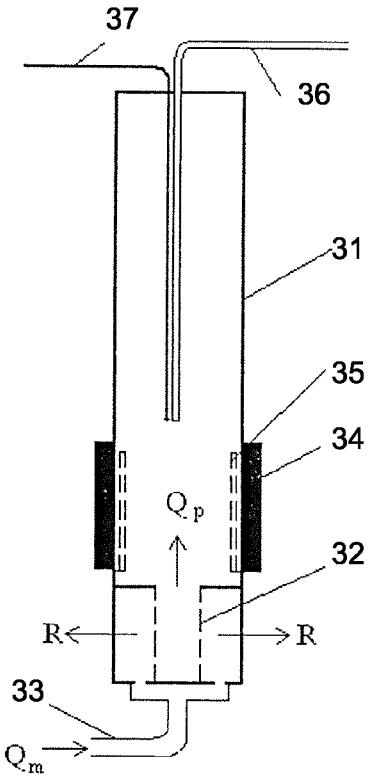
FIG. 3*a* is a simplified schematic diagram of an experimental setup used in experimental testing of the subject invention development.
Figure 3B:
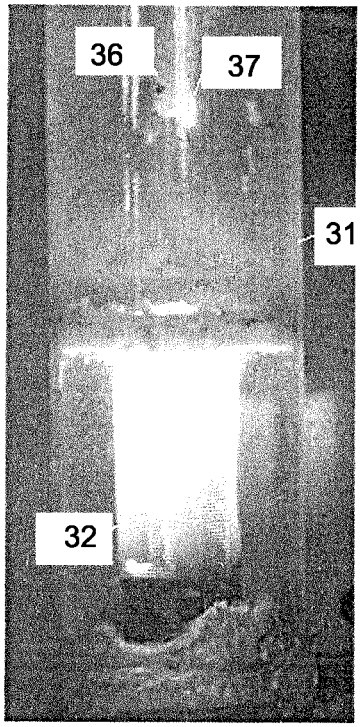
FIG. 3*b* is a photo diagram of a tested burner.

A metal mesh matrix burner was tested imitating the process heater design and operation. FIG. 3*a* is a simplified schematic diagram of the experimental setup, including quartz tube 31, metal mesh matrix 32, air-natural gas mixture supply tube 33, thermal insulation 34, corrugated metal insert 35, gas analyzer probe 36, thermocouple 37, and radiation flux sensor R. The burner firing rate was 2.0 kW. The burner includes a cylindrical wire mesh matrix made of FeCrAl material. The outside diameter of the matrix was 23 mm and the matrix length was 60 mm. The wire mesh dimensions: wire diameter 0.4 mm, mesh size 0.6×0.6 mm. The matrix was placed inside a quartz tube. The length and internal diameter of the quartz tube were 350 mm and 48 mm correspondingly (FIGS. 3*a-b*). Combustion occurred on the inner surface of the cylindrical matrix. A Y-shaped insert was installed inside the matrix for increased radiation, flow turbulization and even distribution of the combustion products at the outlet of the matrix. The insert was made of three stainless steel plates. The plates were of a thickness of 0.4 mm and a length of 60 mm. The use of a quartz tube transparent in the spectral region of ~3 micrometers, corresponding to the maximum of the Planck distribution at a matrix temperature of ~1000 K, made it possible to ensure the effective radiative cooling of the matrix from a large area of its back surface. This ensured a significant redistribution of energy flows, thereby increasing the infrared radiation power, and accordingly, decreasing the flame temperature. Consequently, one could expect a noticeable reduction in the concentration of nitrogen oxides in the combustion products.

To ensure the completion of the oxidation reaction of carbon monoxide, almost adiabatic conditions were created at the initial stage of the motion of the combustion products in the quartz tube. For this purpose, in a number of experiments, the outer part of the quartz tube, from the matrix edge, was covered with thermal insulation over a length of 140 mm. In other experiments, a 140-mm-high insert made of a corrugated mesh fabricated from 50-micrometer-thick stainless steel wire was installed inside the tube. This insert, warming up from the combustion products, isolated them from the cold walls of the tube, i.e., acted as an internal heat insulator.

To compare the effectiveness of these methods with traditional catalytic methods for reducing the concentration of carbon monoxide, control experiments were performed. A catalytic insert (Pd/Al2O3 catalyst) in the form of a cylindrical corrugated wire-made mesh, 48 mm in diameter, 72 mm in height, and 0.4 mm in thickness, or in the form of a volumetric permeable block of height 74 mm (twisted mesh) was placed over the outlet cross section of the matrix.

The experiments were carried out using a mixture of natural gas and air, which was prepared in a mixer and fed into the burner. The air-fuel ratio was kept near stoichiometric (excess air, $\alpha$=5-10%). The burner firing rate did not exceed 2 kW.

Four different regimes were studied: (1) combustion without a thermal insulation or any insert in the quartz tube, (2) combustion in the presence of thermal insulation on part of the outer portion of the quartz tube, (3) combustion in the presence of a corrugated stainless steel insert inside the tube; (4) combustion in the presence of catalytic inserts inside the tube.

Figure 4:
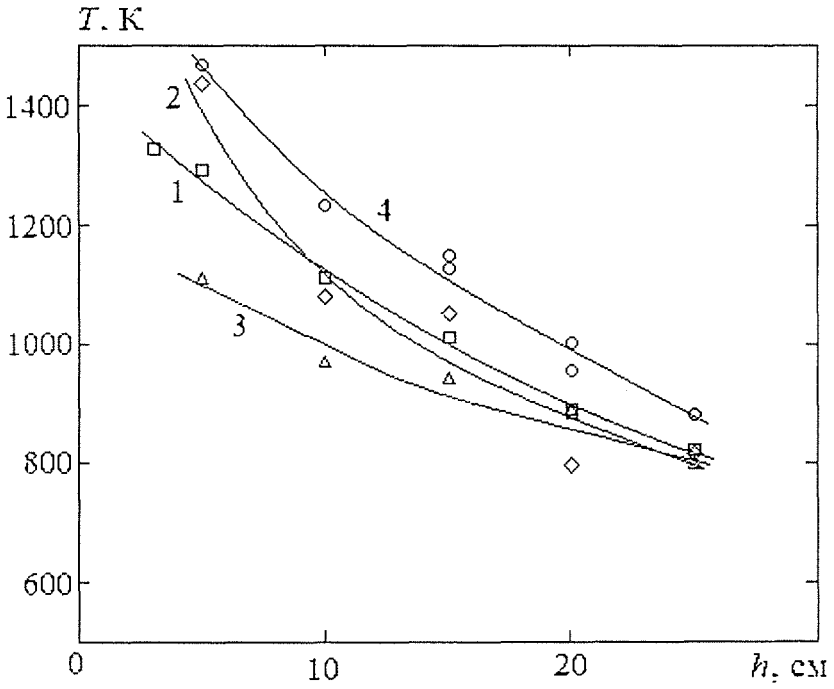
FIG. 4 is a graphical presentation of the distribution of the temperature in the combustion products along the height of the quartz tube for a burner device: (1) without an insert or thermal insulation, (2) with a corrugated wire insert, (3) with a corrugated catalytic insert, and (4) with an insulation of the tube.

During the operation of the burner, a strong radiant emission from the backside of the wire matrix through the transparent wall of the quartz tube was observed (FIG. 3*b*). Thermocouple measurements along the tube axis for the different combustion modes at a fixed values of the firing rate w=20 W/cm2 and excess air $\alpha$=5%, showed a monotonous decrease in the temperature of the combustion products along the height h, starting from the outlet section of the matrix (FIG. 4). This decrease in the temperature of the combustion products is mainly due to the convective heat transfer to the tube wall.

Figure 5A:
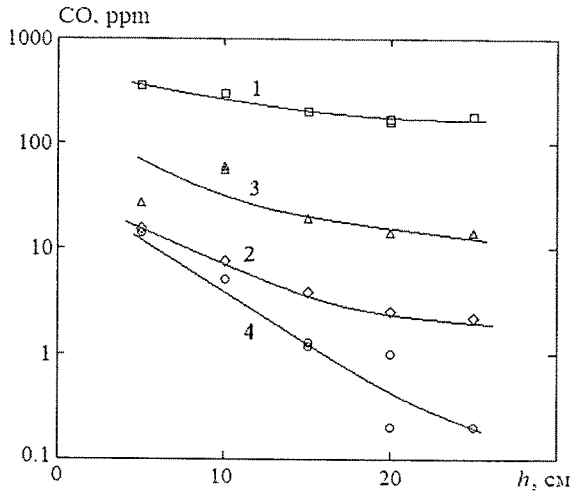
FIG. 5*a* and FIG. 5*b* are graphical presentations of the dependence of the concentrations of (a) carbon monoxide (CO) and (b) nitrogen oxides (NOx), respectively, in the combustion products along the height starting from the edge of the matrix for a burner device: (1) without an insert and thermal insulation, (2) with a corrugated wire insert, (3) with a corrugated catalytic insert, and (4) with a thermal insulation of the tube.

As can be seen from FIG. 4, the maximum temperature was realized in the case of using the external thermal insulation (line 4). The drop in temperature over the insulated portion of the tube is apparently due to the radiation cooling of the gas. The experiments showed that providing and maintaining a high temperature of the combustion products over a long portion of the tube allowed a significant reduction in the concentration of carbon monoxide. In the measurements with the corrugated insert and with the heat insulation of the tube, the CO concentration decreased hundreds of times, to a record low level of several ppm at a distance of only 10-15 cm from the burner outlet section (FIG. 5*a*, lines 2 and 4). The efficiency of the catalytic cylindrical insert was noticeably worse, and the effect of using the thermal insulation was comparable with the use of a volumetric catalytic insert at a measurement point 20 cm away from the outlet section of the matrix (FIG. 5*a*, lines 4 and 5).

Figure 5B:
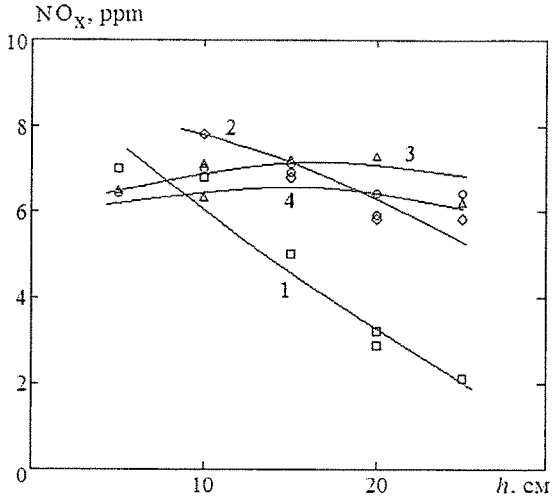

In all cases, the concentrations of nitrogen oxides in the combustion products were very low, less than 8 ppm, and record low NOx concentrations were achieved in the case of a tube without the use of the external thermal insulation or internal inserts (FIG. 5*b*). The low values of the NOx concentration are associated with a lower flame temperature for the surface combustion of the mixture on the burner matrix under conditions of strong radiative heat transfer and the ensuing freezing of the formation of nitrogen oxides in the combustion products as they move along the tube. That the NOx concentration noticeably decreased along the flow, as recorded by the gas analyzer in the experiments without the insert or thermal insulation, is possibly associated with a partial conversion of NO to NO2 in this temperature range, bearing in mind that the gas analyzer detector records only the NO concentration. The total concentration of NOx probably remains unchanged. Note that the use of the catalytic inserts did not affect the concentration of nitrogen oxides.

Figure 6A:
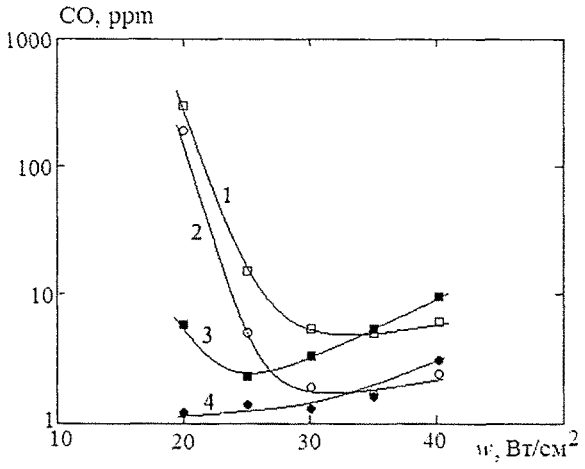
FIG. 6*a* and FIG. 6*b* are graphical presentations of the dependence of the concentrations of (a) carbon monoxide (CO) and (b) nitrogen oxides (NOx), respectively, in the combustion products on the firing rate for the case of the tube (1, 2) without and (3, 4) with thermal insulation at heights of h=(1, 3) 10 and (2, 4) 15 cm.
Figure 6B:
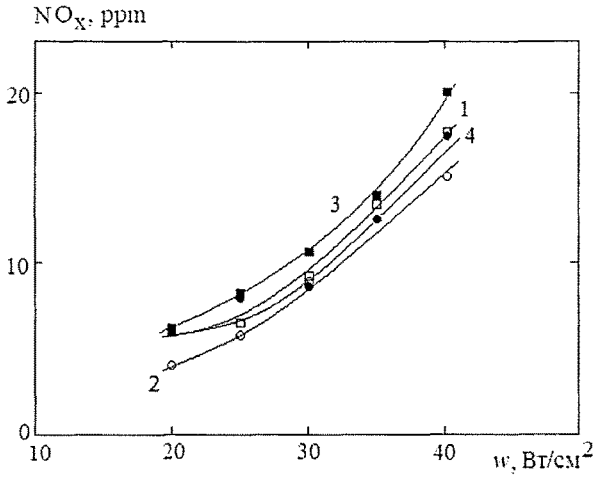

The increase in the temperature of the combustion products with the firing rate at excess air $\alpha$=5% resulted in a significant decrease in the carbon monoxide concentration, to less than 10 ppm at a height of h>10 cm above the matrix edge, even in the case without any thermal insulation and catalytic insert (FIG. 6*a*). However, record low concentrations of CO (1-3 ppm) were achieved in the region of maximum temperatures of the combustion products at PD=20-30 W/cm2 when a portion of the tube was insulated (FIG. 6*a*, line 4). At a high firing rate, the use of thermal insulation became ineffective, since even without it, a high temperature of the products was achieved, which ensured an efficient oxidation of CO. However, with increasing temperature of the products, the concentration of nitrogen oxides increased sharply, exceeding 10 ppm at PD>30-35 W/cm2 (FIG. 6*b*).

Thus, the experiments performed demonstrated the possibility of implementation of an energetically efficient and environmentally friendly combustion of stoichiometric and near-stoichiometric gas mixtures. For surface combustion on a permeable cylindrical matrix, because of a strong heat transfer from the flame front to the matrix, the flame temperature decreases, which led to a significant decrease in the concentration of nitrogen oxides in the combustion products. The faster the radiative cooling of the matrix, the lower the flame temperature and, consequently, the NOx concentration. Combustion at low temperature is realized in conventional radiant burners with a flat matrix. However, as mentioned above, their use is ineffective, since the concentration of carbon monoxide in the combustion products is too high, the firing rate is generally low, PD~20-40 W/cm2, and the concentration limits of combustion of mixtures are rather narrow. The use of a bulk matrix makes it possible to increase the energy efficiency of combustion by five or more times, depending on the ratio of the surface area of the matrix to that of the outlet cross section of the burner device. Under the conditions of the experiments, the maximum rate of firing on the matrix was PD=40 W/cm2, or 416 W per cm2 of the outlet cross section of the matrix.

In burners with a matrix fabricated from a foamed metal, sufficiently low concentrations of nitrogen oxides (less than 15 ppm) were achieved at a high output firing rate, PD>200 W/cm2. The radiative cooling of the matrix was ensured by the emission of radiation from its cavity. The backside of the matrix was relatively cold. A burner matrix in the form of cylindrical thin-wire mesh provides a high radiation flux from the outside of the matrix. Therefore, in order to increase the efficiency of radiative cooling of the matrix, the burner housing must be either transparent for this radiation or absolutely black, but cooled. As the material of the housing, a quartz tube, transparent in the spectral region of ~1-3 micrometer, where the radiation flux is maximal, can be used. Note that in the practical implementation of a burner device, for example, for a hot-water boiler, this radiation flow is not lost, but absorbed by the coolant.

The idea of reducing the CO concentration in combustion products came from analysis of a different thermal process using a different burner, namely a volumetric matrix burner. In such device, the CO emissions were significantly lower as compared to flat-matrix burners. This is explained by the fact that, in the extended cavity of a volumetric matrix, the oxidation of CO to CO2 is largely completed. To optimize the conditions for this effect to take place, it is necessary to maintain a high temperature of the reaction products in the deep cavity, but not sufficient to achieve high concentrations of nitrogen oxides. The results of calculations carried out using the GASEQ thermodynamic code and the expressions for the global simulation of the reactions CO+O2→CO2 and CO+O2+H2O→CO2 have shown that, at temperatures of ~1200-1300 K, CO is rapidly oxidized to CO2 within a characteristic time of ~0.1 s. Under the conditions of the experiments, this time turned out to be approximately equal to the characteristic time of transport of the combustion products from the matrix exit to a distance of ~10-15 cm. In view of the foregoing, the combustion of gases in a burner placed in a quartz tube a portion of which was covered by a thermal insulation from the outside or a corrugated thin-mesh shield was inserted in it to prevent the thermal contact of the combustion products with the relatively cold wall turned out to be efficient.

A practical implementation of a burner for a water heater or boiler in accordance with one embodiment is as follows: A metal mesh matrix is placed directly into the water-heating tube, the wall of which in the area of the matrix is blackened, whereas the internal corrugated heat-insulating insert is installed above the outlet cross section of the matrix. Replacing the open flame burner in a water heater or boiler with a radiant (or infrared) matrix burner by applying the above approach to gas combustion will ensure environmentally friendly combustion products while maintaining a high energetic efficiency of water heating or boiling.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

Although specific advantages have been enumerated above, various embodiments may include some, none, or all of the enumerated advantages.

The invention illustratively disclosed herein suitably may be practiced in the absence of any element, part, step, component, or ingredient which is not specifically disclosed herein.

The claims are not intended to include, and should not be interpreted to include, means-plus- or step-plus-function limitations, unless such a limitation is explicitly recited in a given claim using the phrase(s) "means for" or "step for," respectively.

What is claimed is:

1. A process heater comprising:

a tank adapted to contain a body of liquid;

a heat exchange tube including at least a first end disposed in the body of liquid;

a radiant permeable matrix burner disposed inside of the heat exchange tube at the first end, the burner including an outlet end and configured to produce hot combustion products directed from the outlet end of the burner into the heat exchange tube;

an oxidant-fuel mixer to mix an oxidant material with a fuel material to form a combustible mixture of oxidant and fuel, the oxidant-fuel mixer exteriorly disposed adjacent the first end of the heat exchange tube in oxidant-fuel mixture fluid transfer communication with the radiant burner; and a thermally insulated insert disposed within the heat exchange tube adjacent the outlet end of the radiant burner opposite the oxidant-fuel mixer, wherein the thermally insulated insert is configured to limit heat transfer to the heat exchange tube from the combustion products directed from the outlet end of the radiant burner.

2. The process heater of claim 1 wherein the thermally insulated insert has a shape of an annular cylinder.

3. The process heater of claim 1 wherein the body of liquid comprises water.

4. The process heater of claim 1 wherein the oxidant material comprises air.

5. The process heater of claim 1 wherein the fuel material comprises natural gas.

6. The process heater of claim 1 wherein the oxidant-fuel mixer comprises a fuel injector.

7. The process heater of claim 1 wherein the oxidant-fuel mixture comprises an air to fuel ratio that is 0% up to 30% air in excess of complete combustion of the fuel.

8. The process heater of claim 1 wherein the oxidant-fuel mixture combusts within or on the surface of the permeable matrix.

9. The process heater of claim 1 wherein the radiant burner combusts the oxidant-fuel mixture to produce combustion products containing ≤10 ppm $NO_x$ and <10 ppm CO at 3% oxygen (dry basis).

10. The process heater of claim 1 wherein the radiant permeable matrix burner comprises a cylindrical shaped metal wire mesh of high temperature material.

11. The process heater of claim 1 wherein the radiant permeable matrix burner comprises a permeable metal foam matrix of high temperature material.

12. The process heater of claim 1 wherein the thermally insulated insert comprises a metal corrugated foil.

13. The process heater of claim 1 wherein the radiant permeable matrix burner comprises a permeable metal foam matrix additionally comprising a second thermally insulating insert disposed within the heat exchange tube exteriorly adjacent the permeable metal foam matrix.

14. The process heater of claim 13 wherein the second thermally insulating insert has a shape of an annular cylinder.

15. The process heater of claim 1 wherein the heat exchange tube includes a second end opposite the first end and wherein combustion products produced by the burner are discharged.

16. A method of operating the process heater of claim 1, the method comprising:

feeding the oxidant material and the fuel material to the oxidant-fuel mixer;

mixing the oxidant material with the fuel material to form the combustible mixture of oxidant and fuel;

combusting the combustible mixture of oxidant and fuel via the radiant permeable matrix burner to produce hot combustion products; and directing the hot combustion products into the heat exchange tube and into heat transfer communication with the body of liquid.

17. A method for processing heat, the method comprising:

introducing an oxidant material and a fuel material into an oxidant-fuel mixer disposed exteriorly adjacent a first end of a heat exchange tube, the tube including at least a first end disposed in a body of liquid contained in a tank;

mixing the oxidant material with the fuel material to form a combustible mixture of oxidant and fuel;

transferring the combustible mixture of oxidant and fuel to a radiant permeable matrix burner disposed inside of the heat exchange tube;

combusting the combustible mixture of oxidant and fuel to produce hot combustion products via the radiant permeable matrix burner disposed inside of the heat exchange tube, the heat exchange tube including a thermally insulated insert disposed therein adjacent an outlet end of the radiant burner opposite the oxidant-fuel mixer;

limiting heat transfer to the heat exchange tube from the outlet end of the radiant burner through the thermally insulated insert; and transferring heat from the hot combustion products to the body of liquid contained in the tank via the heat exchange tube.

18. The method of claim 17 wherein the thermally insulated insert disposed within the heat exchange tube has a shape of an annular cylinder.

19. The method of claim 17 wherein the body of liquid comprises water, the oxidant material comprises air and the fuel material comprises natural gas.

20. The method of claim 17 wherein the radiant permeable matrix burner combusts the combustible mixture of oxidant and fuel to produce combustion products containing ≤10 ppm $NO_x$ and <10 ppm CO at 3% oxygen (dry basis).

* * * * *